US007527347B2

(12) United States Patent
Mukai

(10) Patent No.: US 7,527,347 B2
(45) Date of Patent: May 5, 2009

(54) INK JET PRINT HEAD AND INK JET PRINTING APPARATUS HAVING A PLURALITY OF SLITS FORMED IN A HEATER SUBSTRATE MOUNTING SURFACE

(75) Inventor: Kayo Mukai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 377 days.

(21) Appl. No.: 11/393,663

(22) Filed: Mar. 31, 2006

(65) Prior Publication Data

US 2006/0221139 A1 Oct. 5, 2006

(30) Foreign Application Priority Data

Apr. 4, 2005 (JP) ..... 2005-107701

(51) Int. Cl.
*B41J 2/015* (2006.01)

(52) U.S. Cl. ..... 347/20; 347/56

(58) Field of Classification Search ..... 347/20, 347/56, 61–65, 67

See application file for complete search history.

(56) References Cited

U.S. PATENT DOCUMENTS 5,389,957 A * 2/1995 Kimura et al. ..... 347/20

FOREIGN PATENT DOCUMENTS

JP 2001-138528 A 5/2001

* cited by examiner

*Primary Examiner*—Juanita D Stephens
(74) *Attorney, Agent, or Firm*—Fitzpatrick, Cella, Harper & Scinto

(57) ABSTRACT

The present invention is intended to alleviate stresses that occur in a bonding surface between the heater substrate and the base plate due to effects of heat history in the ink jet print head manufacturing process and to heat produced during the printing operation. To this end, the present invention provides an ink jet print head comprising: a heater substrate formed with heaters to generate thermal energy for ejecting ink; and a base plate mounted to that part of a surface of the heater substrate in which the heaters are not formed; wherein a plurality of slits each of which extends in a direction perpendicular to a direction of an array of the heaters formed in the heater substrate are formed in a heater substrate mounting surface of the base plate at predetermined intervals in a direction of an array of the heaters.

5 Claims, 6 Drawing Sheets

INK JET PRINT HEAD AND INK JET PRINTING APPARATUS HAVING A PLURALITY OF SLITS FORMED IN A HEATER SUBSTRATE MOUNTING SURFACE

BACKGROUND OF THE INVENTION

1. Field of the Invention

The present invention relates to an ink jet print head and an ink jet printing apparatus and more specifically to a technology that prevents warping and cracking of a heater substrate by alleviating stresses of a base plate forming the ink jet print head.

2. Description of the Related Art

In an ink jet system that heats ink by a heating resistor to eject an ink droplet, a substrate in which ejection energy generation devices are provided (hereinafter referred to as a "heater substrate") is conventionally joined to a base plate of a different material from that of the heater substrate.

There is a construction in which a slit is provided at ends of an interface of the joint to alleviate stresses produced at the joint interface because of a difference in expansion coefficient between the heater substrate and the base plate as the temperature of the print head varies (see Japanese Patent Application Laid-open No. 2001-138528).

According to the method of the Japanese Patent Application Laid-open No. 2001-138528, however, there is no other alternative but to provide a slit at the ends of the joint interface, excluding a nozzle column, because of a physical structure of the base plate and a nozzle plate, with the result that stresses may develop at the joint interface in an area of the nozzle column due to the expansion coefficient difference.

Especially with an elongate print head that employs a thermal ink jet system and has a wide print width, there is a large temperature dynamic range. So, serious problems, such as warping and cracking of the print head may result.

SUMMARY OF THE INVENTION

An object of the present invention is to provide an ink jet print head which can alleviate stresses that occur in a bonding surface between a heater substrate and a base plate due to effects of heat history in an ink jet print head manufacturing process and to heat produced during a printing operation, and which can therefore prevent warping and cracking of the heater substrate and achieve a high quality printing. It is also an object of this invention to provide an ink jet printing apparatus incorporating such an ink jet print head.

To achieve the above objective, the present invention provides an ink jet print head comprising: a heater substrate formed with heaters to generate thermal energy for ejecting ink; and a base plate mounted to that part of a surface of the heater substrate in which the heaters are not formed; wherein a plurality of slits each of which extends in a direction perpendicular to a direction of an array of the heaters formed in the heater substrate are formed in a heater substrate mounting surface of the base plate member at predetermined intervals in a direction of an array of the heaters.

Further, a ratio between a separation distance of the adjoining slits and a width of the slits is preferably smaller than 374:1.

This invention further provides an ink jet print head comprising: a heater substrate formed with heaters to generate thermal energy for ejecting ink; and a base plate mounted to that part of a surface of the heater substrate in which the heaters are not formed; wherein the base plate is divided in a direction of an array of the heaters formed in the heater substrate at at least one location.

It is preferred that a ratio in the heater array direction between a separation distance of the divided base plates and a width of the divided base plates be smaller than 1:374.

This invention further provides an ink jet printing apparatus having the ink jet print head described above and causing the heaters to heat the ink and produce bubbles to eject the ink onto a print medium to form an image on it.

With this invention, warping and cracking of the heater substrate in the heater array direction caused by thermal expansion coefficient differences can be prevented, realizing a print head construction which enable ink to land precisely and has durability to a high speed printing and it can therefore achieve a high quality printing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of this invention will be described in detail by referring to the accompanying drawings.

Preferred embodiments to implement the present invention will be explained in the following.

The embodiments that follow are examples of means for implementing the invention and are subject to modifications and changes as required depending on the configuration and condition of the apparatus to which the invention is applied. The present invention therefore is not limited to the following embodiments.

Figure 1:
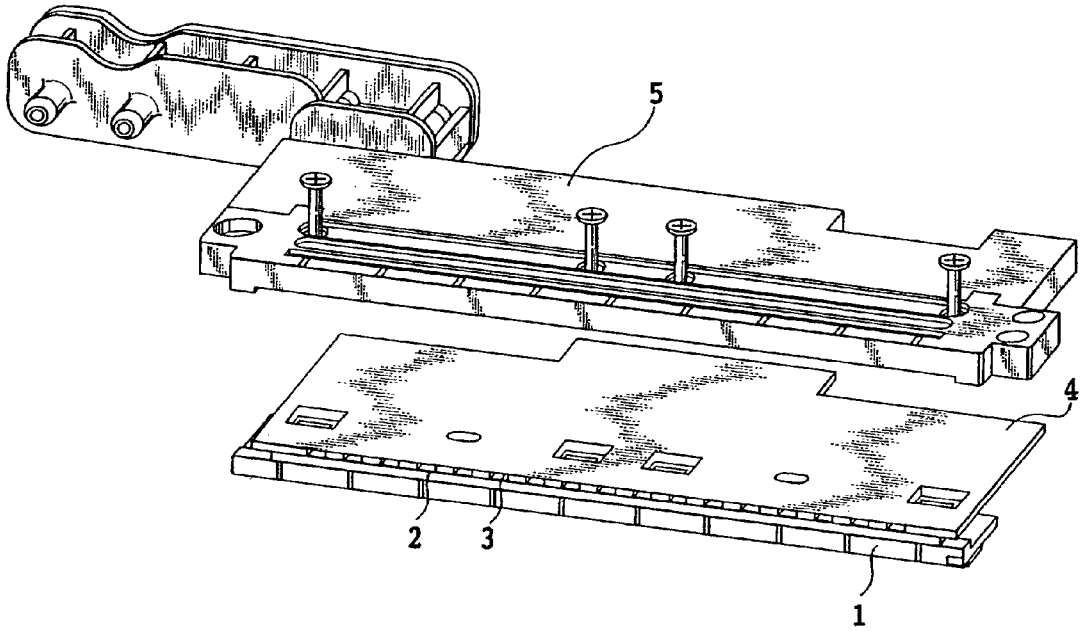
FIG. 1 is a perspective view showing a construction of an ink jet print head as one embodiment of this invention.

FIG. 1 shows a construction of an ink jet print head having a 4-inch print width in one embodiment of this invention.

In FIG. 1, a base plate 1 is made of aluminum and supports a heater substrate 2 formed of silicon. The heater substrate 2 has a plurality of fluid path walls forming nozzles (fluid paths) corresponding to individual ejection energy generation devices, and a liquid chamber frame to enclose a common liquid chamber communicating with the nozzles. The base plate 1 is preferably made of metal and ceramic materials from a standpoint of thermal deformation characteristics and smoothness.

Joined and mounted to the nozzle side walls (fluid path walls) and the liquid chamber frame is a flat top plate 3 having an ink supply port to supply ink to the common liquid chamber. In other words, the heater substrate 2 and the top plate 3 are held together and bonded to the base plate 1 in a laminated state.

The laminated layer bonding is done using a bonding agent with high heat conductivity such as silver paste. As shown in FIG. 2C, on an upper surface of the base plate 1 behind the heater substrate 2 a mounted printed circuit board (PCB) 4 is secured by a double-sided adhesive tape. Further, an ink supply member 5 is joined from above to the upper surface of the top plate 3. Through an ink supply path formed in the ink supply member 5 an ink is supplied to the top plate 3. The ejection energy generation devices on the heater substrate 2 are electrically connected individually to wires on the PCB 4 by wire bonding.

Figure 4:
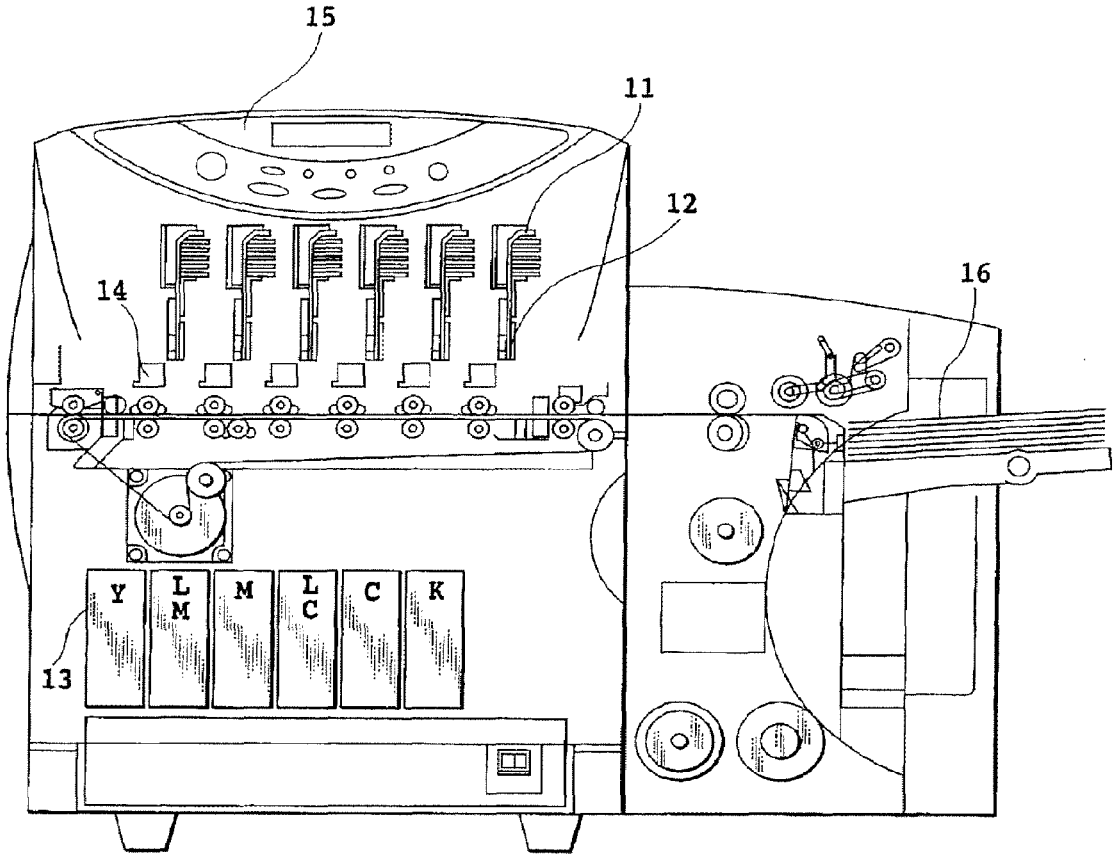
FIG.4 PRIOR ART
FIG. 4 illustrates an interior of an ink jet printing apparatus mounting the ink jet print head of the embodiment of this invention.

FIG. 4 is a schematic front view showing an inner construction of one embodiment of an ink jet printing apparatus with an ink jet print head of this invention.

In FIG. 4, the ink jet printing apparatus comprises a plurality of ink jet print heads 11, recovery units 12 one for each of the print heads, ink tanks 13, a transport unit 14, an operation panel 15, and a paper feed unit 16. A sheet of paper is supplied from the paper feed unit to the transport unit and the print heads are moved by a drive means not shown to a print position for printing.

Figure 5A:
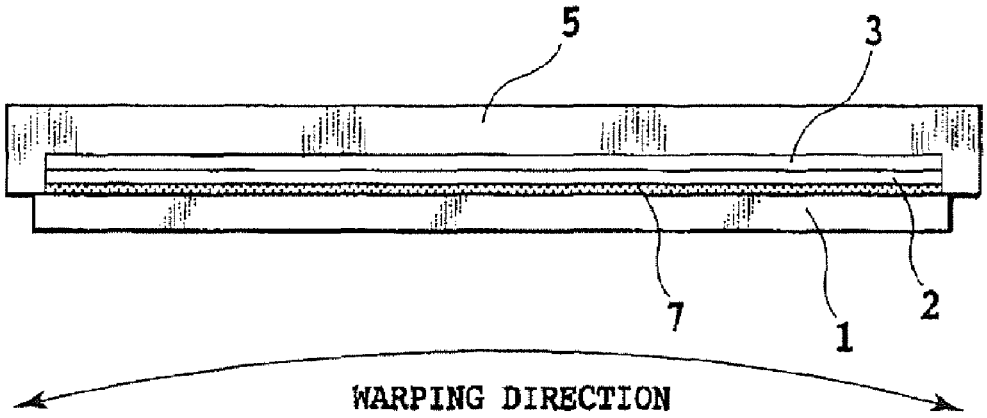
FIG.5A PRIOR ART
FIGS. 5A and 5B are detailed views showing an ink ejection portion of a conventional ink jet print head.
Figure 5B:
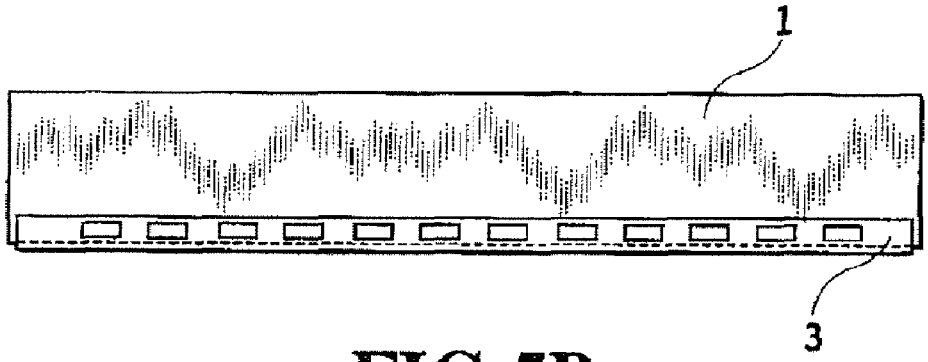
FIG.5B PRIOR ART

FIGS. 5A and 5B show details of an ink ejection portion in a conventional ink jet print head. FIG. 5A illustrates ink ejection nozzles as seen from the front. FIG. 5B is a top view of FIG. 5A. FIG. 5B does not show the PCB 4 and an ink supply member 5 for convenience. As described above, the base plate 1 and the heater substrate 2 are bonded together by the silver paste 7. The manufacturing process of the print head will be described as follows.

The silver paste 7 is applied by a screen printing to the heater substrate interface of the base plate 1 to a uniform thickness, and then the heater substrate 2 is placed at a predetermined position on the base plate 1.

With the heater substrate 2 held by suction to suction holes formed in the base plate 1, a temporary fixing agent is used to position the heater substrate 2 in place. After the temporary fixing agent hardens, the attraction by suction is stopped and the silver paste is cured. Normally, this cure takes two hours at 150° C.

Silicon forming the heater substrate has a thermal expansion coefficient of $2.6\times10^{-6}$ and aluminum forming the base plate $24\times10^{-6}$. In an assembly process of the ink jet print head having a 4-inch print width, suppose the room temperature is 25° C. and the cure process is performed at 150° C. In that case, the elongation by heat expansion of the silicon heater substrate will be 35.4 μm and the elongation of the aluminum base plate 326.7 μm. Their difference is 291.3 μm. Thus, after curing, when the temperature is returned to normal, a contraction difference will occur between the silicon heater substrate and the aluminum base plate. This causes a stress to develop in the bonding surface of the two members, resulting in a warping of the head in the direction of arrow of FIG. 5A or a cracking of the heater substrate.

Figure 2A:
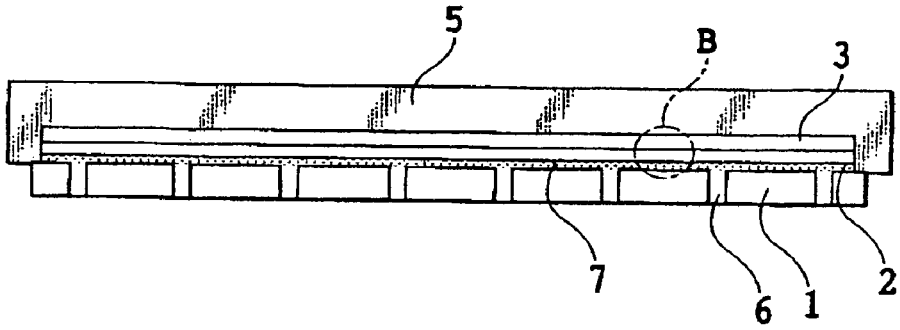
FIGS. 2A to 2D are detailed views showing an ink ejection portion of the ink jet print head of the embodiment of this invention.
Figure 2B:
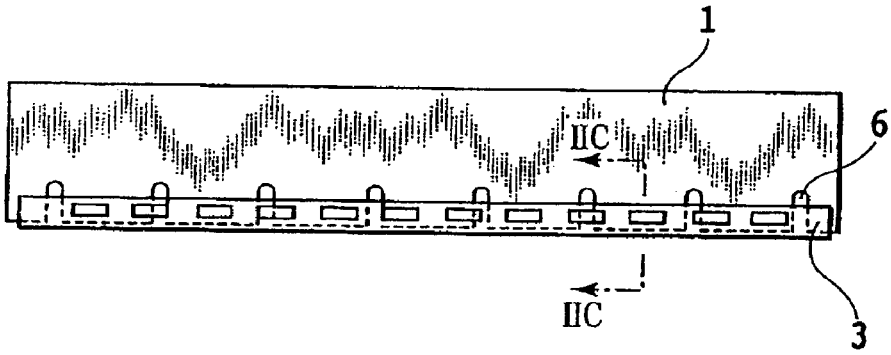
Figure 2C:
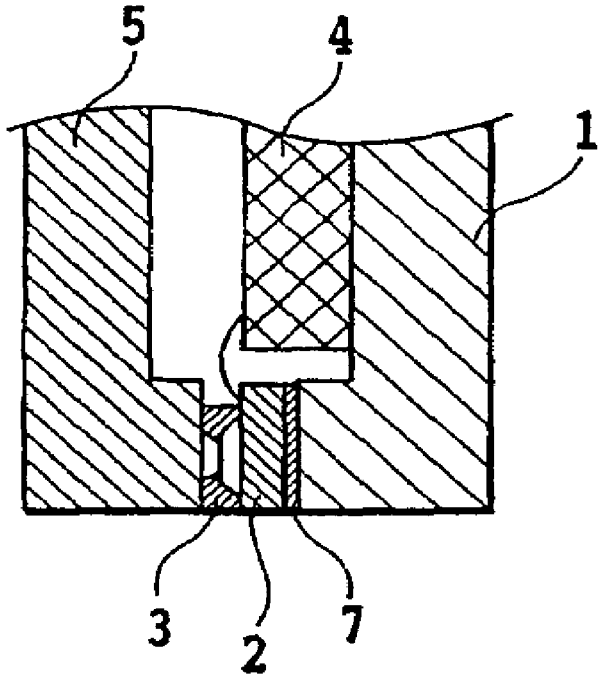
Figure 2D:
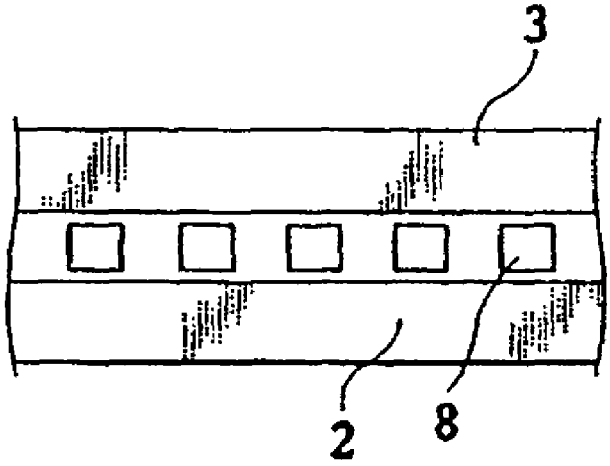

FIG. 2A to FIG. 2D show details of an ink ejection portion of the ink jet print head in the embodiment of this invention. FIG. 2A is a front view of the ink ejection nozzles 8. FIG. 2B is a top view of FIG. 2A. FIG. 2C is a cross-section taken along the line IIC-IIC of FIG. 2B. FIG. 2D is an enlarged view of a portion B of FIG. 2A. FIG. 2B does not show the PCB 4 and the ink supply member 5 for convenience. In FIG. 2A, the base plate 1 has a plurality of slits 6 formed in its bonding surface to which the heater substrate is secured. The heater substrate 2 is die-bonded by the silver paste 7 to the base plate 1.

Figure 3A:
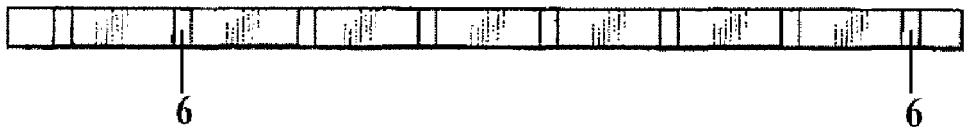
FIGS. 3A and 3B are detailed views showing a base plate of the ink jet print head of the embodiment of this invention.
Figure 3B:
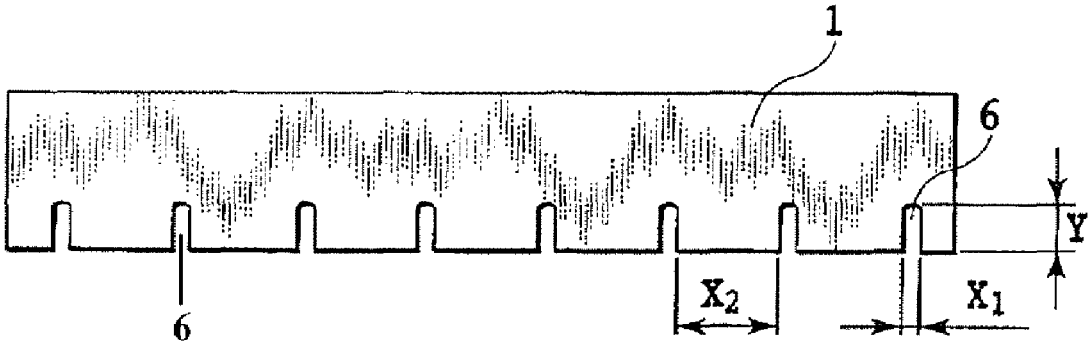

FIG. 3A and FIG. 3B are detailed views of the base plate in the embodiment of this invention. FIG. 3A shows the base plate on the ink ejection nozzle side and FIG. 3B is a top view of FIG. 3A. As shown in FIG. 3A and FIG. 3B, the heater substrate bonding surface of the base plate 1 is formed with slits 6 extending in a direction perpendicular to that in which the ejection energy generation devices are arrayed in the heater substrate. Let X1 be a width of each slit, X2 be a distance between one slit end surface and the adjoining slit end surface, and Y be a slit depth. In this embodiment, X1 is set to 0.5 mm, X2 to 11 mm and Y to 5 mm. By having X1 and X2 in the following relation, a desired position precision and reliability of the nozzles can be realized.

$$X1:X2=1:374 \text{ or less}$$

That is, the ratio of X2 to X1, or X2:X1, needs only to be set smaller than 374:1 (X2/X1<374).

As a result, a difference between the base plate elongation and the heater substrate elongation for the distance X2 from one slit end surface to the adjoining slit end surface can be absorbed by the slit width X1. The object of this invention can therefore be accomplished.

If we let Δt in the bonding agent curing process described above be 125° C., the difference between the silicon elongation and the aluminum elongation for the distance of X2 can be expressed by $$(24-2.6)\times10^{-6}\times125\times X2=2.675\times10^{-3}\times X2$$

X2 is so set that the value of the above difference is smaller than the slit width X1. Thus, if X1 is 1, X2 is set in a manner that satisfies $2.675\times10^{-3}\times X2<1$, i.e., X2<374.

Therefore, designing the base plate to meet the requirement of X1:X2=1:374 or less makes it possible to absorb the elongation difference between the base plate and the heater substrate by the slit width X1. This in turn alleviates the stresses that occur between the base plate and the heater substrate.

Since in this embodiment the setting of X1:X2=0.5 mm:11 mm was made, a desired nozzle position precision and reliability could be achieved.

In the case of a ceramic base plate too, the same relation can be applied. That is, ceramics has a rate of thermal expansion of $7\times10^{-6}$ and aluminum $24\times10^{-6}$ or less, so determining X1 and X2 for the dimensional ratio described above can alleviate the stresses sufficiently.

With the above embodiment, even in a print head construction in which the heater substrate having an array of heater devices and the base plate of a different material are laminated and bonded, stresses that occur in the bonding surface between the heater substrate and the base plate due to influences of heat history in the print head manufacturing process and to heat produced during the printing operation can be alleviated by forming slits in the heater substrate bonding surface of the base plate so that they extend in a direction perpendicular to that in which the heater devices are arrayed in the heater substrate.

Therefore, the warping and cracking of the heater substrate in the direction of array of heater devices caused by thermal expansion coefficient differences are prevented. As a result, the print head construction enables ink to land precisely and has durability to a high speed printing, thus assuring a high quality printing.

Other Embodiments

Instead of forming the slits, the base plate may be divided in a direction of the heater array at at least one location, with the dividing lines extending perpendicular to the heater array direction.

In that case, the ratio in the heater array direction of a separation distance of the adjoining base plates to each divided base plate width needs to be set at 1:374 or less. That is, the ratio in the heater array direction between the width of each of the separated base plates and the separation distance of the adjoining base plates should be set at 374:1 (374/1) or less to produce the similar effect to that of the slits.

The present invention can be applied not only to the ink jet printing apparatus that ejects ink by applying thermal energy to the ink but also to the type of printing apparatus which ejects ink by vibrating piezoelectric devices instead of driving heaters.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2005-107701 filed Apr. 4, 2005, which is hereby incorporated by reference herein.

What is claimed is:

1. An ink jet print head comprising:

a heater substrate formed with heaters to generate thermal energy for ejecting ink; and a base plate mounted to a surface in which the heaters in the substrate are not formed;

wherein a plurality of slits each of which extends in a direction perpendicular to a direction of an array of the heaters formed in the heater substrate are formed in a heater substrate mounting surface of the base plate at predetermined intervals in a direction of an array of the heaters, and wherein a width of the slits is set larger than a difference between an elongation by thermal expansion of the base plate and an elongation by thermal expansion of the heater substrate for a distance between end surfaces of the adjoining slits.

2. The ink jet print head according to claim 1, wherein a ratio between a separation distance of the adjoining slits and a width of the slits is smaller than 374:1.

3. An ink jet printing apparatus having the ink jet print head claimed in claim 1 and causing the heaters to heat the ink and produce bubbles to eject the ink onto a print medium to form an image on it.

4. An ink jet print head comprising:

a heater substrate formed with heaters to generate thermal energy for ejecting ink; and a base plate mounted to that part of a surface of the heater substrate in which the heaters are not formed;

wherein the base plate is divided in a direction of an array of the heaters formed in the heater substrate at at least one location, and wherein a width of the slits is set larger than a difference between an elongation by thermal expansion of the base plate and an elongation by thermal expansion of the heater substrate for a distance between end surfaces of the adjoining slits.

5. The ink jet print head according to claim 4, wherein a ratio in the heater array direction between a width of each of the separated base plates and the separation distance of the divided base plate is smaller than 374:1.

* * * * *

UNITED STATES PATENT AND TRADEMARK OFFICE

CERTIFICATE OF CORRECTION

PATENT NO. : 7,527,347 B2
APPLICATION NO. : 11/393663
DATED : May 5, 2009
INVENTOR(S) : Kayo Mukai It is certified that error appears in the above-identified patent and that said Letters Patent is hereby corrected as shown below:

ON THE TITLE PAGE ITEM [73]:

Assignee, "Canon Kabushiki Kaisha" should read --Canon Finetech Inc.--.

Signed and Sealed this

Twenty-second Day of September, 2009

David J. Kappos

David J. Kappos
*Director of the United States Patent and Trademark Office*